US006035952A

United States Patent [19]

Bradfield et al.

[11] Patent Number: 6,035,952

[45] Date of Patent: Mar. 14, 2000

[54] CLOSED LOOP FLUID-HANDLING SYSTEM FOR USE DURING DRILLING OF WELLBORES

[75] Inventors: David H. Bradfield, Grove Wantage; David P. J. Cummins, Newbury; Phillip J. Bridger, Rugby, all of United Kingdom

[73] Assignee: Baker Hughes Incorporated, Houston, Tex.

[21] Appl. No.: 08/964,947

[22] Filed: Nov. 5, 1997

Related U.S. Application Data

[63] Continuation-in-part of application No. 08/642,828, May 3, 1996, Pat. No. 5,857,522.

[51] Int. Cl.[7] ..... E21B 21/06

[52] U.S. Cl. ..... 175/66; 175/207

[58] Field of Search ..... 175/25, 38, 42, 175/48, 66, 207; 166/267, 75.11, 265, 105.1, 192

[56] References Cited

U.S. PATENT DOCUMENTS

| | | | |
|---|---|---|---|
| 4,255,269 | 3/1981 | Timmer | 175/207 X |
| 4,449,594 | 5/1984 | Sparks . | |
| 5,010,966 | 4/1991 | Stockley et al. | 175/66 |
| 5,109,933 | 5/1992 | Jackson | 175/66 |
| 5,129,468 | 7/1992 | Parmenter | 175/66 |
| 5,249,635 | 10/1993 | King et al. . | |
| 5,411,105 | 5/1995 | Gray . | |
| 5,415,776 | 5/1995 | Homan . | |
| 5,842,149 | 11/1998 | Harrell et al. | 702/9 |

FOREIGN PATENT DOCUMENTS 0 047 347 3/1982 European Pat. Off. .

*Primary Examiner*—Frank Tsay
*Attorney, Agent, or Firm*—Madan, Mossman & Sriram P.C.

[57] ABSTRACT

This invention provides a fluid-handling system for use in underbalanced drilling operations. The system includes a first vessel which acts as a four phase separator. The first vessel includes a first stage for separating solids. Oil and gas are separated at a second stage. A pressure sensor provides signals to a pressure controller, which modulates a gas flow valve coupled to the vessel for discharging gas from the first vessel. The pressure controller maintains the pressure in the first vessel at a predetermined value. An oil level sensor placed in the first vessel provides a signal to an oil level controller. The oil level controller modulates an oil flow valve coupled to the vessel to discharge oil from the first vessel into a second vessel. Water is discharged into a third vessel. Water from the third vessel is discharged via a water flow control valve, which is modulated by a level controller as a function of the water level in the third vessel. Any gas in the third vessel is discharged by modulating a gas control valve as a function of the pressure in the third vessel. In an alternative embodiment, a central control unit or circuit is utilized to control the operations of all the flow valves. During operations, a control unit maintains the pressure and the levels of the fluids in such vessels at their respective predetermined values according to programmed instructions. The fluid-handling system also controls the wellbore pressure as a function of downhole-measured parameters and the drilling fluid mix as a function of selected operating parameters.

16 Claims, 3 Drawing Sheets

CLOSED LOOP FLUID-HANDLING SYSTEM FOR USE DURING DRILLING OF WELLBORES

CROSS-REFERENCE TO RELATED APPLICATIONS

This application is a continuation-in-part of U.S. patent application Ser. No. 08/642,828, filed on May 3, 1996, now U.S. Pat. No. 5,857,522.

BACKGROUND OF THE INVENTION

1. Field of the Invention

This invention relates generally to drilling of wellbores and more particularly to a fluid-handling system for use in underbalanced drilling of wellbores.

2. Background of the Art

In conventional drilling of wellbores for the production of hydrocarbons from subsurface formations, wellbores are drilled utilizing a rig. A fluid comprising water and suitable additive, usually referred to in the art as "mud," is injected under pressure through a tubing having a drill bit which is rotated to drill the wellbores. The pressure in the wellbore is maintained above the formation pressure to prevent blow-outs. The mud is circulated from the bottom of the drill bit to the surface. The circulating fluid reaching the surface comprises the fluid pumped downhole and drill cuttings. Since the fluid pressure in the wellbore is greater than the formation pressure, it causes the mud to penetrate into or invade the formations surrounding the wellbore. Such mud invasion reduces permeability around the wellbore and reduces accuracy of measurements-while-drilling devices commonly used during drilling of the wellbores. Such wellbore damage (also known as the skin damage or effect) may extend from a few centimeters to several meters from the wellbore. The skin damage results in a decrease in hydrocarbon productivity.

To address the above-noted problems, some wells are now drilled wherein the pressure of the circulating fluid in the wellbore is maintained below the formation pressure. This is achieved by maintaining a back pressure at the wellhead. Since the wellbore pressure is less than the formation pressure, fluids from the formation (oil, gas and water) co-mingles with the circulating mud. Thus, the fluid reaching the surface contains four phases: cuttings (solids), water, oil and gas. Such drilling systems require more complex fluidhandling systems at the surface. The prior art systems typically discharge the returning fluids ("wellstream") into a pressure vessel or separator at the surface to separate sludge (solids), water, oil and gas. The pressure in the vessel typically exceeds 1000 psi. A number of manually controlled valves are utilized to maintain the desired pressure in the separator and to discharge the fluids from the pressure vessel. These prior art systems also utilize manually controlled emergency shut down valves to shut down the drilling operations. Additionally, these systems rely upon pressure measured at the wellhead to control the mud pressure downhole. In many cases this represents a great margin of error. These prior art fluid-handling systems require the use of high pressure vessels, which are (a) relatively expensive and less safe than low pressure vessels, (b) relatively inefficient, and (c) require several operators to control the fluid-handling system.

The present invention addresses the above-noted deficiencies of the prior art fluid-handling systems and provides a relatively low pressure fluid-handling system which utilizes remotely controlled fluid flow control devices and pressure control devices, along with other sensors to control the separation of the constituents of the wellstream. The present invention also provides means for controlling the wellbore pressure from the surface as a function of the downhole measured pressure.

SUMMARY OF THE INVENTION

This invention provides a fluid-handling system for use in underbalanced drilling operations. The system includes a first vessel which acts as a four phase separator. The first vessel includes a first stage for separating solids. Oil and gas are separated at a second stage into separate reservoirs. A pressure sensor associated with the first vessel provides a signal to a pressure controller which modulates a gas flow valve coupled to the vessel for discharging gas from the first vessel. The pressure controller maintains the pressure in the first vessel at a predetermined value. An oil level sensor placed in the first vessel provides a signal to an oil level controller. The oil level controller modulates an oil flow valve coupled to the vessel to discharge oil from the first vessel into a second vessel. The oil level controller operates the oil flow valve so as to maintain the oil level in the first vessel at a predetermined level. Similarly, water (fluid that is substantially free of oil and solids) is discharged into a third vessel. Water from the third vessel is discharged via a water flow control valve, which is modulated by a level controller as a function of the water level in the third vessel. Any gas in the third vessel is discharged by modulating a gas control valve as a function of the pressure in the third vessel.

In an alternative embodiment, a central control unit or circuit is utilized to control the operations of all the flow valves. Signals from the pressure sensors and level sensors are fed to the control unit, which controls the operations of each of the flow control valves based on the signals received from the various sensor and in accordance with programmed instructions. During operations, the control unit maintains the pressure in each of the vessels at their respective predetermined values. The control unit also maintains the fluid levels in each of the vessels at their respective predetermined values.

The system of the present invention also determines the downhole pressures, including the formation pressure and controls the drilling fluid flow into the wellbore to maintain a desired pressure at the wellhead. The system also automatically controls the drilling fluid mix as a function of one or more desired operating parameters to control the density of the circulating fluid.

Examples of the more important features of the invention have been summarized rather broadly in order that the detailed description thereof that follows may be better understood, and in order that the contributions to the art may be appreciated. There are, of course, additional features of the invention that will be described hereinafter and which will form the subject of the claims appended hereto.

BRIEF DESCRIPTION OF THE DRAWINGS

For detailed understanding of the present invention, references should be made to the following detailed description of the preferred embodiment, taken in conjunction with the accompanying drawings, in which like elements have been given like numerals, wherein.

DETAILED DESCRIPTION OF PREFERRED EMBODIMENTS

Figure 1:
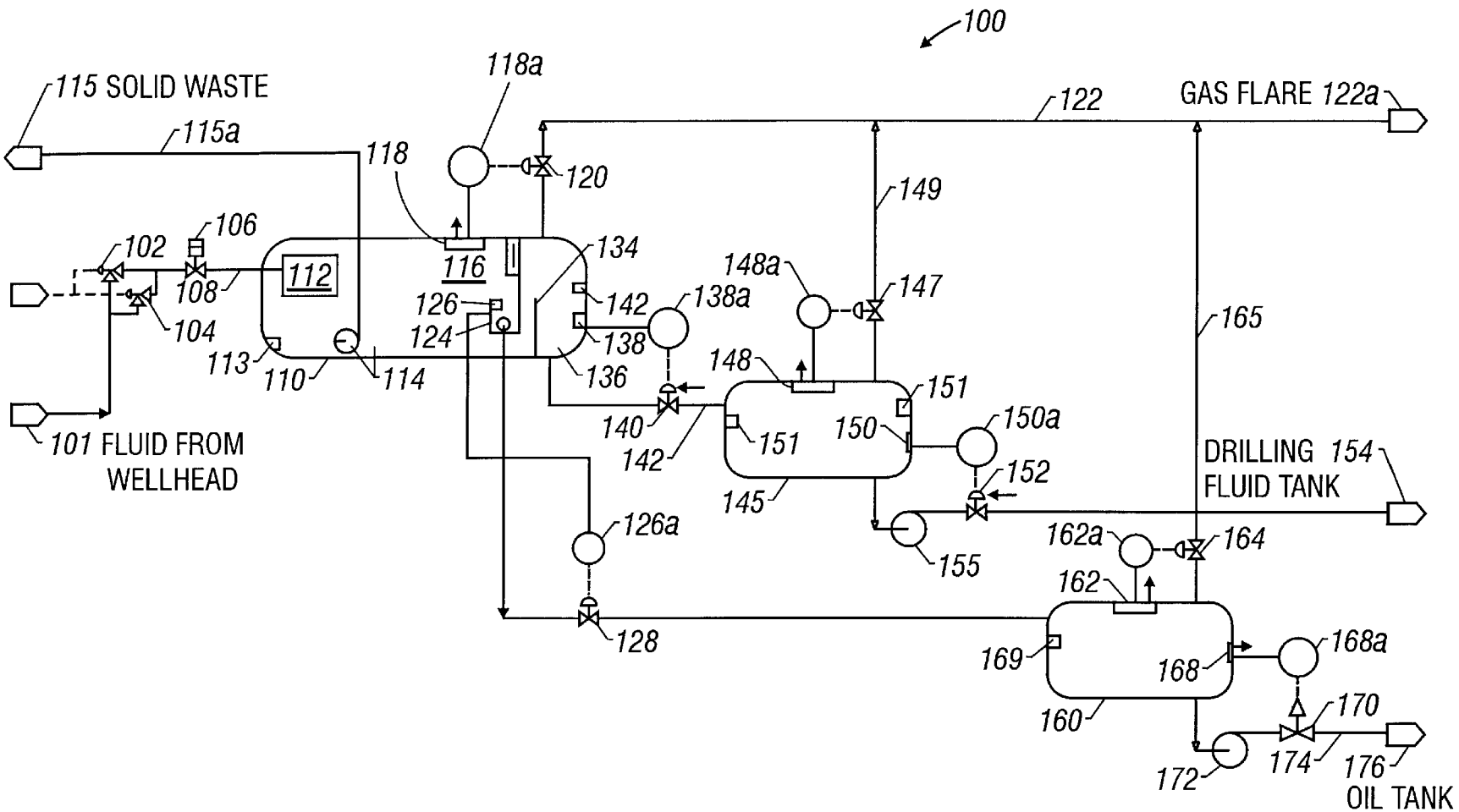
FIG. 1 shows a schematic of a fluid handling system according to the present invention.

FIG. 1 shows a schematic of a fluid-handling system 100 according to the present invention. During underbalanced drilling of a wellbore, a drilling fluid (also referred to as the "mud") is circulated through the wellbore to facilitate drilling of the wellbore. The fluid returning from the wellbore annulus (referred herein as the "wellstream") typically contains the drilling fluid originally injected into the wellbore, oil, water and gas from the formations, and drilled cuttings produced by the drilling of the wellbore.

In the system 100, the wellstream passes from a wellhead equipment 101 through a choke valve 102 which is duty-cycled at a predetermined rate.

A second choke valve 104 remains on hundred percent (100%) standby. The duty-cycled valve 102 is electrically controlled so as to maintain a predetermined back pressure. The wellstream then passes through an emergency shut-down valve ("ESD") 106 via a suitable line 108 into a four phase separator (primary separator) 110. The choke valve 102 creates a predetermined pressure drop between the wellhead equipment 110 and the primary separator 100 and discharges the wellstream into the primary vessel at a relatively low pressure, typically less than 100 psi. In some applications, it may be desirable to utilize more that one choke valve in series to obtain a sufficient pressure drop. Such choke valves are then preferably independently and remotely controlled as explained in more detail later.

Figure 1A:
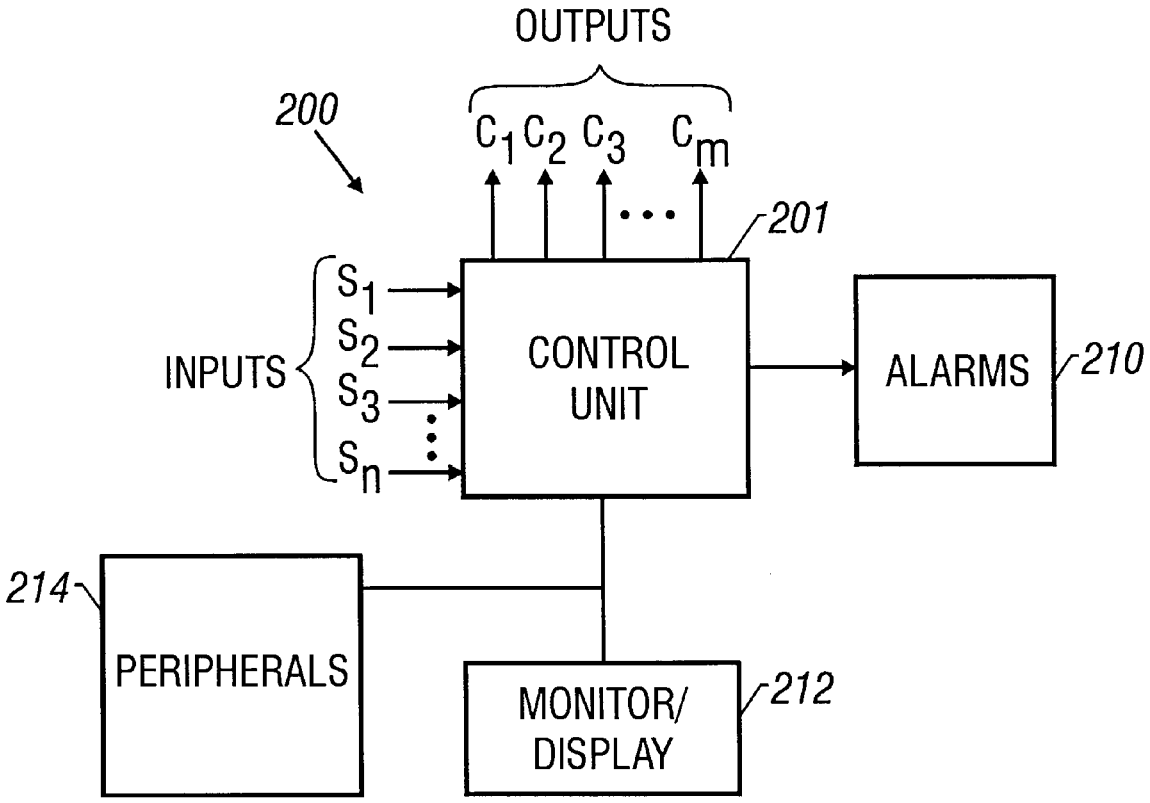
FIG. 1A shows a functional block diagram of a control system for use with the system of FIG. 1 for controlling the operation of the fluid handling system.

The primary separator 110 preferably is a four phase separator. The wellstream entering into the separator 110 passes to a first stage of the separator 110. Solids (sludge), such as drilled cuttings, present in the wellstream are removed in the first stage by gravity forces that are aided by centrifugal action of an involute entry device 112 placed in the separator 110. Such separation devices 112 are known in the art and, thus, are not described in detail. Any other suitable device also may be utilized to separate the solids from the wellstream. The solids being heavier than the remaining fluids collect at the bottom of the primary separator 100 and are removed by a semi-submersible sludge pump 114. A sensor 113 detects the level of solids build-up in the separator 110 and energizes the pump 114 to discharge the solids from the separator 110 into a solids waste place 115 via a line 115*a*. The operation of the sludge pump 114 is preferably controlled by a control system placed at a remote location. FIG. 1A shows a control system 200 having a control unit or control circuit 201, which receives signals from a variety of sensors associated with the fluid-handling system 100, determines a number of operating parameters and controls the operation of the fluid-handling system 100 according to programmed instruction and models provided to the control unit 201. The operation of the control system 200 is described in more detail later.

The fluid that is substantially free of solids passes to a second stage, which is generally denoted herein by numeral 116. The second stage 116 essentially acts as a three phase separator to separate gas, oil and water present in the fluids entering the second stage. The gas leaves the separator 110 via a control valve 120 and line 122. The gas may be flared or utilized in any other manner. A pressure sensor 118 placed in the separator 110 and coupled to the control unit 201 is used to continually monitor the pressure in the separator 110. The control unit 201 adjusts the control valve 120 so as to maintain the pressure in the vessel 110 at a predetermined value or within a predetermined range. Alternatively, a signal from the pressure sensor 118 may be provided to a pressure controller 118*a,* which in turn modulates the control valve 120 to maintain the pressure in the separator at a predetermined value. Both a high and a low pressure alarm signals are also generated from the pressure sensor 118 signal. Alternatively, two pressure switches may be utilized, wherein one switch is set to provide a high pressure signal and the other to provide a low pressure signal. The control unit 201 activates an alarm 210 (FIG. 1*a*) when the pressure in the separator is either above the high level or when it falls below the low level.

The control unit 201 may also be programmed to shut down the system 100 when the pressure in the separator is above a predetermined maximum level ("high-high") or below a predetermined minimum level ("low-low").

Alternatively, the system 100 may be shut down upon the activation of pressure switches placed in the separator, wherein one such switch is activated at the high-high pressure and another switch is activated at the low-low pressure. The high-high pressure trip protects against failure of the upstream choke valves 102 and 104, while the low-low trip protects the system against loss of containment within the vessel 110.

The oil contained in the fluid at the second stage 116 collects in a bucket 124 placed in the second stage 1 16 of the separator 110. A level sensor 126 associated with the bucket 124 is coupled to the control unit 201, which determines the level of the oil in the bucket 124. The control unit 201 controls a valve 128 to discharge the oil from the separator 110 into an oil surge tank 160. Alternatively, the level sensor 126 may provide a signal to a level controller 126*a*, which modulates the control valve 128 to control the oil flow from the bucket 124 into the oil surge tank 160. The oil level sensor signals also may be used to activate alarms 210 when the oil level is above a maximum level or below a minimum level.

In the second stage 116, fluid that is substantially free of oil (referred to herein as the "water" for convenience) flows under the oil bucket 124 in the area 116 and then over a weir 134 and collects into a water chamber or reservoir 136. A level sensor 138 is placed in the water reservoir 136 and is coupled to the control unit 201, which continually determines the water level in the reservoir 136. The control unit 201 is programmed to control a valve 140 to discharge the water from the separator 110 into a water tank 145 via a line 142. Alternatively, the level sensor 128 may provide a signal to a level controller 138*a* which modulates the control valve 140 to discharge the water from the separator 110 into the water tank 145. Additionally, the liquid level in the main body of the separator is monitored by a level switch 142 which provides a signal when the liquid level in the main body of the separator 110 is above a maximum level, which signal initiates the emergency shut down. This emergency shut down prevents any liquid passing into the gas vent 11 or into any flare system used.

Any gas present in the water discharged into the water tank separates within the water tank 145. Such gas is discharged via a control valve 147 to flare. A pressure sensor 148 associated with the water tank 145 is utilized to control the control valve 147 to maintain a desired pressure in the water tank 145. The control valve 147 may be modulated by a pressure controller 148*a* in response to signals from the pressure sensor 148. Alternatively, the control valve 147 may be controlled by the control unit 201 in response to the signals from the pressure sensor 148. Alarms are activated when the pressure in the water tank 145 is above or below predetermined limits. Water level in the water tank 145 is monitored by a level sensor 150. A level controller 150*a* modulates a control valve 152 in response to the level sensor signals to maintain a desired liquid level in the water tank 145. Alternatively, control unit 201 may be utilized to control the valve 152 in response to the level sensor signals. The fluid level in the water tank 145 also is monitored by a level switch 151, which initiates an emergency shutdown of the system if the level inadvertently reaches a predetermined maximum level. A pump 155 passes the fluids from the water tank 145 to the control valve 152. The fluid leaving the valve 152 discharges via a line 153 into a drilling fluid tank 154.

Any gas present in the oil surge tank 160 separates within the oil surge tank 160. The separated gas is discharged via a control valve 164 and a line 165 to the gas line 122 to flare. A pressure sensor 162 associated with the oil surge tank 160 is utilized to control the control valve 164 in order to maintain a desired pressure in the oil surge tank 160. The control valve 164 may be modulated by a pressure controller 162*a* in response to signals from the pressure sensor 162. Alternatively, the operation of the control valve 164 may be controlled by the control unit 201 in response to the signals from the pressure sensor 162. Alarms 210 are activated when the pressure in the oil surge tank 160 is either above or below their respective predetermined limits. Oil level in the oil surge tank 160 is monitored by a level sensor 168. A level controller 168*a* modulates a control valve 170 in response to the level sensor signals to maintain a desired liquid level in the oil surge tank 160. Alternatively, the control unit 201 may be utilized to control the valve 170 in response to the signals from the level sensor 168. The liquid level in the oil surge tank 160 also is monitored by a level switch 169, which initiates an emergency shutdown of the system if the level inadvertently reaches a predetermined maximum level. A pump 172 passes the fluids from the oil surge tank 160 to the control valve 170. The fluid leaving the valve 170 discharges via a line 174 into an oil tank or oil reservoir 176.

Still referring to FIGS. 1 and 1A, the control unit 201 may be placed at a suitable place in the field or in a control cabin having other control equipment for controlling the overall operation of the drilling rig used for drilling the wellbore. The control unit 201 is coupled to one or more monitors or display screens 212 for displaying various parameters relating to the fluid-handling system 100. Suitable data entry devices, such as touch-screens or keyboards are utilized to enter information and instructions into the control unit 201. The control unit 201 contains one or more data processing units, such as a computer, programs and models for operating the fluid-handling system 100.

In general, the control unit 201 receives signals from the various sensors described above and any other sensors associated with the fluid-handling system 100 or the drilling system. The control unit 201 determines or computes the values of a number of operating parameters of the fluid-handling system and controls the operation of the various devices based on such parameters according to the programs and models provided to the control unit 201. The ingoing or input lines $S_1$–$S_n$ connected to the control unit 201 indicate that the control unit 201 receives signals and inputs from various sources, including the sensors of the system 100. The outgoing or output lines $C_1$–$C_m$ are shown to indicate that the control unit 201 is coupled to the various devices in the system 201 for controlling the operations of such devices, including the control valves 102, 104, 120, 128 147, 152, 64, 168 and 170, and pumps 124, 155 and 170.

Figure 2:
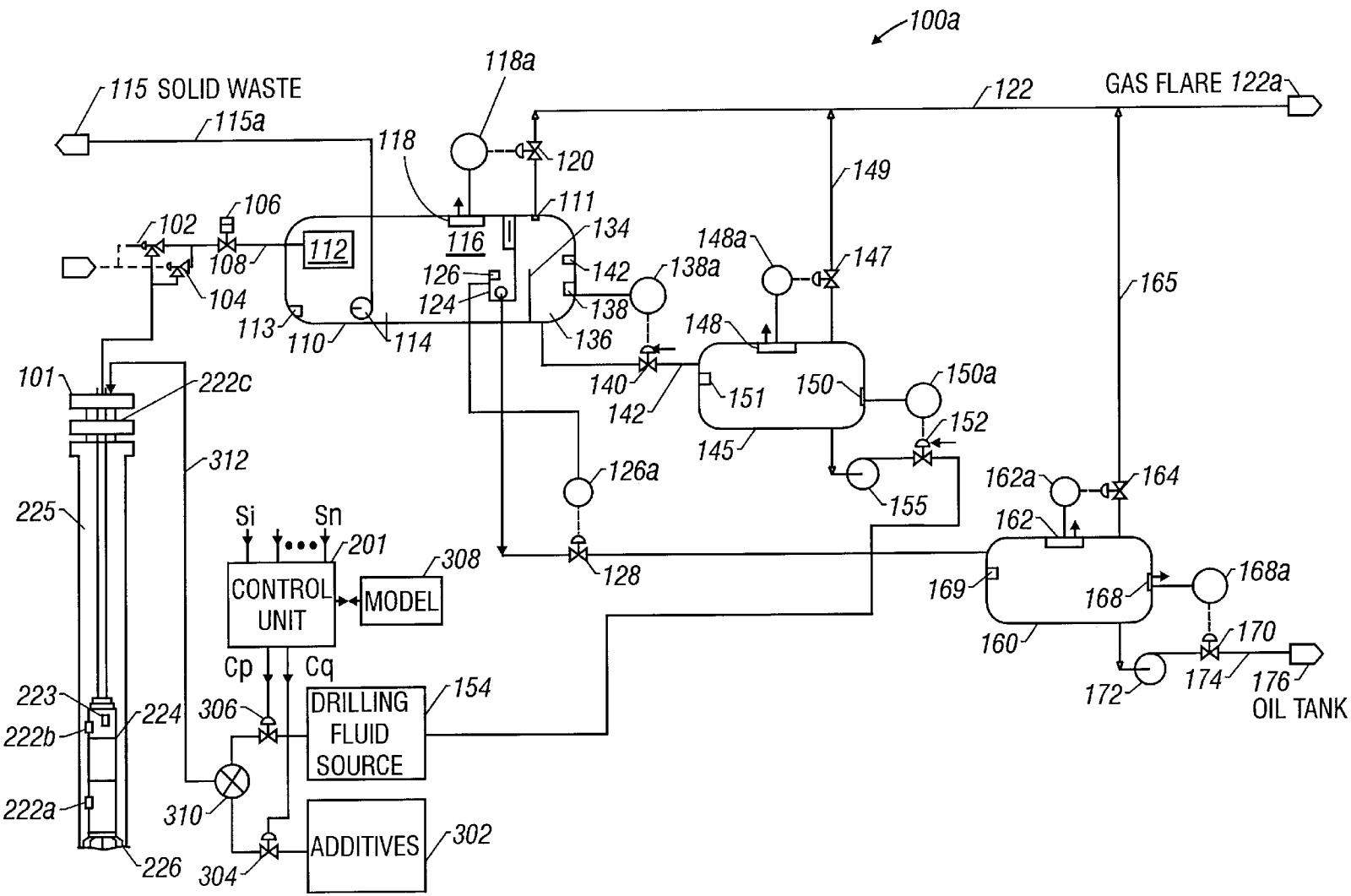
FIG. 2 shows the fluid handling system of FIG. 1 in conjunction with a schematic representation of a wellbore with a drilling assembly conveyed therein for automatically controlling the wellhead pressure, downhole circulating fluid pressure and the drilling fluid mix.

Referring now to FIGS. 1, 1A and 2, prior to the operation of the system 100, an operator stationed at the control unit 201, which is preferably placed at a safe distance from the fluid-handling system 100, enters desired control parameters, including the desired levels or ranges of the various parameters, such as the fluid levels and pressure levels. As the drilling starts, the control unit 201 starts to control the flow of the wellstream from the wellbore 225 by controlling the valves 102 and 104 so as to maintain a desired back pressure.

The control unit 201 also controls the pressure in the separator 110, the fluid levels in the separator 110 and each of the tanks 145 and 160, the discharge of solids from the separator 110 and the discharge of the gases and fluids from the tanks 145 and 170.

As noted earlier, prior art systems control the wellbore pressure by maintaining the pressure at the surface at a desired value. Based on the depth of the wellbore and the types of fluids utilized during drilling of the wellbore, the actual downhole pressure can vary from the desired pressure by several hundred pounds. In order to accurately control the pressure in the wellbore, the present system includes a pressure sensor 222*c* for measuring the pressure at the wellhead 101, a pressure sensor 222*b* in the drill string 224 for measuring the pressure of the drilling fluid in the drill string 224 and a pressure sensor 222*c* in the drill string 224 for measuring the pressure in the annulus between the drill string 224 and the wellbore 225. Other types of sensors, such as differential pressure sensors, may also be utilized for determining the differential pressures downhole. During the drilling operations, the control unit 201 periodically or continually monitors the pressures from the sensors 222*a*, 222*b* and 222*c* and controls the fluid flow rate into the wellbore 225 by controlling so as to maintain the wellbore pressure at a predetermined value or within a predetermined range. The drill string 224 may also include other sensors, such as a temperature sensor 223, for measuring the temperature in the wellbore 225.

During underbalanced drilling, the drilling fluid is mixed with other materials, such as nitrogen, air, carbon dioxide, air-filled balls and other additives to control the drilling fluid density or the equivalent circulating density and to create foam in the drilling fluid to provide gas lift downhole. FIG. 2 shows an embodiment 100*a* of the fluid handling system of the present invention which can automatically control the drilling fluid mix as a function of downhole measured operating parameters, such as the formation pressure, or any other selected parameters. As shown in FIG. 2, the system 100*a* includes one or more sources 302 of materials (additives) to be mixed with the drilling mud from the mud tank 154. The drilling fluid from the mud tank 154 passes to a mixer 310 via an electrically-controlled flow valve 304. The additives from the source 302 pass to the mixer 310 via an electrically-controlled flow valve 306. The controller 201 receives information about the downhole parameters from the various sensors $S_1$–$S_n$, including the pressure sensors 222*a*, 222*b*, and 222*c*, and temperature sensor 223 and determines the selected parameters to be controlled, such as the formation pressure. The system 100*a* is provided with a model 308 for use by the control unit 201 to determine the drilling fluid mix. The control unit 201 periodically or continually determines the required fluid mix as a function of one or more of the selected operating parameters and operates the control valve 304 via control line $C_q$ to discharge the correct amount of the additive materials to obtain the desired mix. The control unit 201 also controls the fluid control valve 306 via line $C_p$ to control the drilling fluid flow into the mixer 310. The mixed fluid is discharged into the wellbore 225 from the mixer 310 via line 312 to maintain the desired pressure in the wellbore. The mud from the mud tank 154 and the additives from the source 302 are preferably mixed at a juncture or mixer 310 and discharged into the wellbore via line 312. The additives and the drilling fluid, however, may be injected separately into the wellbore 225. In some applications it may be more desirable to inject the additives at or near the bottom of the drill string 224 via a separate line (not shown) so that the mixing occurs near the drill bit 226.

Thus, the fluid handling system of the present invention provides a closed loop fluid handling system which automatically separates the wellstream into its constituent parts, discharges the separated constituent parts into their desired storage facilities. The system also automatically controls the pressure in the wellbore and drilling fluid mixture as a function of selected operating parameters.

The above-described system requires substantially less manpower to operate in contrast to known fluid-handling systems utilized during underbalanced drilling of wellbores. The pressure in the main separator 110 is relatively low compared to known prior art systems, which typically operate at a pressure of more than 1000 psi. Low pressure operations reduce the costs associated with manufacture of separators. More importantly, the low pressure operations of the present system are inherently safer that the relatively high pressure operations of the prior art systems. The control of the wellhead pressure and the drilling fluid mix based on the downhole measurements during the drilling operations provide more accurate control of the pressure in the wellbore.

While the foregoing disclosure is directed to the preferred embodiments of the invention, various modifications will be apparent to those skilled in the art. It is intended that all variations within the scope and spirit of the appended claims be embraced by the foregoing disclosure.

what is claimed is:

1. A fluid-handling system for use during underbalanced drilling of a wellbore, comprising:

(a) a source of drilling fluid for supplying the drilling fluid to the wellbore during drilling of the wellbore;

(b) a source of an additive for supplying a selected additive to the wellbore during drilling of the wellbore;

(c) sensors for taking measurements downhole relating to selected operating parameters during drilling of the wellbore; and (d) a control unit having at least one processor, said control unit determining the required amount of additive to be added into the drilling fluid as function of at least one of the selected operating parameter, said control unit further causing the additive source to inject the required amount of the additive into the drilling fluid.

2. The apparatus as specified in claim 1, wherein the additive is selected from a group comprising air, nitrogen, carbon dioxide, air-filled pellets, and air-filled glass beads.

3. The apparatus as specified in claim 1, wherein the additive is injected into the drilling fluid prior to injecting the drilling fluid into the wellbore.

4. The apparatus as specified in claim 1, wherein the additive is mixed with the drilling fluid after the drilling fluid has been injected into the wellbore.

5. A fluid handling system for use during underbalanced drilling of a wellbore, comprising:

(a) a drill string having a drilling assembly at bottom end of the drill string for drilling the wellbore;

(b) a source of drilling fluid at the surface supplying drilling fluid under pressure to the drill string, said drilling fluid returning to the surface via annulus between the drill string and the wellbore;

(c) a pressure sensor for measuring pressure associated with the wellbore; and (d) a controller responsive to the measured pressure for controlling flow of the drilling fluid from the source of the drilling fluid to maintain pressure in the wellbore at a selected pressure.

6. The fluid handling system according to claim 5 wherein the selected pressure is within a predetermined range of pressures.

7. The fluid handling system according to claim 5 wherein the pressure sensor measures pressure which is one of (i) pressure in the drill string; (ii) pressure in the annulus; (iii) a differential pressure in the wellbore; and (iv) pressure at wellhead over the wellbore at the surface.

8. The fluid handling system according to claim 5 further comprising a source of additive at the surface for supplying additive to the drilling fluid.

9. The fluid handling system according to claim 8 wherein the controller controls the amount of additive supplied to the drilling fluid.

10. The fluid handling system according to claim 5 further comprising a fluid separator at the surface, said fluid separator receiving drilling fluid returning from the wellbore and separating said received fluid into a plurality of phases.

11. The fluid handling system according to claim 10 further comprising a flow control device controlling the flow of the returning fluid into the separator to control back pressure on the wellbore.

12. A method of controlling supply of drilling fluid into a wellbore during underbalanced drilling of the wellbore, comprising:

providing a drill string having a drilling assembly at bottom end of the drill string and drilling the wellbore therewith;

supplying drilling fluid under pressure to the drill string from a source of the drilling fluid at the surface;

measuring pressure associated with the wellbore during the underbalanced drilling of the wellbore; and controlling flow of the drilling fluid to the drill string as a function of the measure pressure to maintain pressure in the wellbore at a selected pressure.

13. The method according to claim 12 wherein measuring pressure includes measuring pressure which is one of (i) pressure in the drill string; (ii) pressure in the annulus; (iii) a differential pressure in the wellbore; (iv) pressure at wellhead disposed over the wellbore.

14. The method according to claim 12 further comprising supplying controlled amounts of an additive to the drilling fluid.

15. The method according to claim 12 further comprising separating the returned fluid into a plurality of phases in a separator.

16. The method according to claim 15 further comprising controlling pressure of the fluid entering the separator below a predetermined value.

* * * * *